US005615698A

United States Patent [19]

Ko

[11] Patent Number: 5,615,698

[45] Date of Patent: Apr. 1, 1997

[54] UMBRELLA FOLDING AND UNFOLDING DEVICE

[76] Inventor: Chin-Sung Ko, 7, Lane 30, Chung Hsiao Street, Changhua, Taiwan

[21] Appl. No.: 651,148

[22] Filed: May 21, 1996

[51] Int. Cl.[6] ..... A45B 25/06

[52] U.S. Cl. ..... 135/28; 135/38; 135/41

[58] Field of Search ..... 135/28, 37, 38, 135/39, 40, 41, 42

[56] References Cited

U.S. PATENT DOCUMENTS

| | | | |
|---|---|---|---|
| 1,434,942 | 11/1922 | Brandt | 135/39 |
| 2,567,284 | 9/1951 | Hacken et al. | 135/39 |
| 2,822,815 | 2/1958 | Bremshey | 135/39 |
| 3,424,180 | 1/1969 | Andolfi | 135/28 X |
| 3,856,032 | 12/1974 | Schafer | 135/41 X |
| 4,951,695 | 8/1990 | Yang | 135/28 X |
| 5,020,558 | 6/1991 | Huang | 135/28 X |
| 5,357,994 | 10/1994 | Chung | 135/28 X |

FOREIGN PATENT DOCUMENTS

| | | | |
|---|---|---|---|
| 1211770 | 3/1966 | Germany | 135/39 |

*Primary Examiner*—Lanna Mai

*Attorney, Agent, or Firm*—Beveridge, DeGrandi, Weilacher & Young, L.L.P.

[57] ABSTRACT

An umbrella frame shaft assembly includes a hollow shaft, a spring piece fastened in the upper segment of the shaft, a runner fitted slidably over the shaft, and a sleeve fastened with the runner. The spring piece has an upper retaining projection and a lower retaining projection. The runner has two retaining holes. The sleeve is provided in the inner wall thereof with two retaining recesses. When the umbrella is being unfolded, the runner is moved upwards along the shaft by the sleeve such that the upper and the lower retaining projections of the spring piece are located by the retraining holes of the runner and engaged with the retaining recesses of the sleeve. When the umbrella is being folded, the upper and the lower retaining projections of the spring piece are forced by the sleeve into the hollow interior of the shaft to allow the runner to be moved downwards by the sleeve.

5 Claims, 3 Drawing Sheets

UMBRELLA FOLDING AND UNFOLDING DEVICE

FIELD OF THE INVENTION

The present invention relates generally to an umbrella frame shaft, and more particularly to the umbrella frame shaft provided with an improved device for folding and unfolding the umbrella.

BACKGROUND OF THE INVENTION

The conventional umbrella frame comprises mainly a shaft, a runner fitted slidably over the shaft, and a plurality of stretchers fastened respectively at one end thereof with the runner. The stretchers are fastened respectively at another end thereof with ribs which are arranged radially and are fastened respectively at one end thereof with the top end of the shaft for stretching the umbrella shade.

The shaft is provided in the upper segment thereof with a spring piece listened movably therewith for folding and unfolding the umbrella. When the umbrella is unfolded by sliding the runner upwards along the shaft, the spring piece is snapped into the hollow interior of the shaft by the runner so as to allow the runner to be moved further upwards to locate at a position immediately over the spring piece. As soon as the runner is moved pass the spring piece, the spring piece is snapped back to its original position to prevent the runner from moving downwards along the shaft. Before the unfolded umbrella is folded, the spring piece is forced with finger into hollow interior of the shaft to allow the runner to slide downwards along the shaft to complete the folding of the umbrella.

Such a conventional umbrella frame shaft assembly as described above is defective in design in that the fingers of a user of the umbrella are rather vulnerable to cut or bruise by the spring piece and the runner in the course of unfolding or folding the umbrella.

SUMMARY OF THE INVENTION

It is therefore the primary objective of the present invention to provide an umbrella frame with a shaft assembly capable of overcoming the safety hazards of the frame shaft assembly of the conventional umbrella described above.

It keeping with the principle of the present invention, the foregoing objective of the present invention is attained by an improved shaft assembly of the umbrella frame. The shaft assembly comprises a shaft of a hollow construction, a spring piece fastened in the upper segment of the shaft, a runner fitted slidable over the shaft, and a sleeve. The spring piece has an upper retaining projection and a lower retaining projection. The runner has two retaining holes. The sleeve is provided in the inner wall thereof with two retaining recesses. When the umbrella is being unfolded, the runner is pushed upwards along the shaft by the sleeve such that the upper and the lower retaining projections of the spring piece are located by the retaining holes of the runner and engaged with the retaining recesses of the sleeve. When the unfolded umbrella is being folded, the upper and the lower retaining projections of the pring piece are forced by the sleeve into the hollow interior of the shaft to allow the runner to be pulled downwards by the sleeve.

The foregoing objective, features, functions and advantages of the present invention will be more readily understood upon a thoughtful deliberation of the following detailed description of an embodiment of the present invention in conjunction with the accompanying drawings.

DETAILED DESCRIPTION OF THE EMBODIMENT

Figure 1:
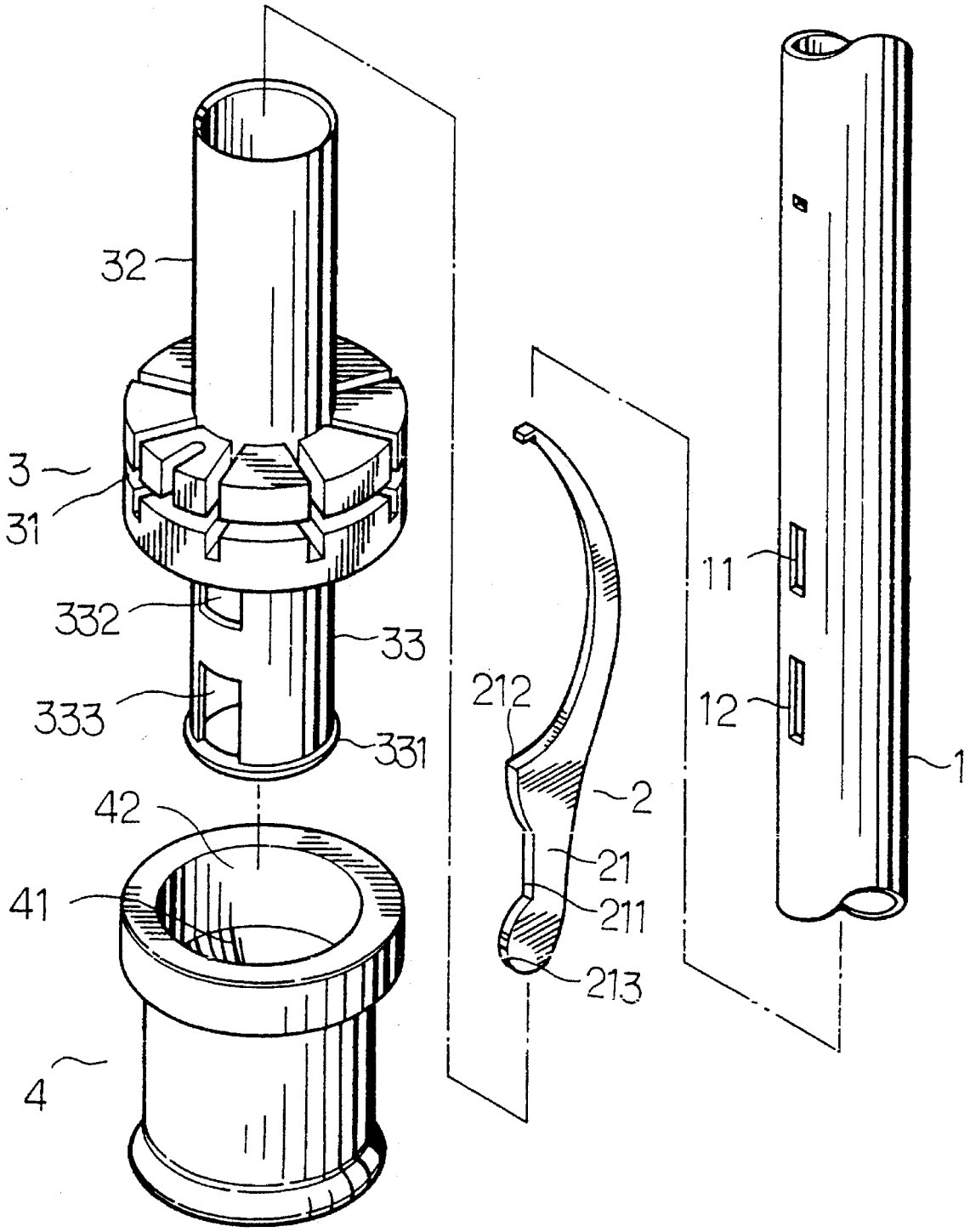
FIG. 1 shows an exploded view of the embodiment of the present invention.

As shown in all drawings provided herewith, an umbrella frame shaft assembly embodied in the present invention is composed of a shaft 1, a spring piece 2, a runner 3, and a sleeve 4.

The shaft 1 is of a hollow construction and is provided in the wall of the segment thereof with two through holes 11 and 12.

The spring piece 2 comprises a retaining protuberance 21 which has a recessed portion 211, an upper retaining projection 212, and a lower retaining projection 213. The recessed portion 211 is located between the upper retaining projection 212 and the lower retaining projection 213 which is greater in height than the upper retaining projection 212.

The runner 3 is made up of a main body 31, an upper tubular portion 32, and a lower tubular portion 33. The runner 3 is slidably fitted over the shaft 1. Located at the bottom end of the lower tubular portion 33 is a flange 331. The lower tubular portion 33 is further provided in the wall thereof with an upper retaining hole 332 and a lower retaining hole 333 coaxial with the upper retaining hole 332. The upper and the lower retaining holes 332 and 333 are intended to locate the upper and the lower retaining projections 212 and 213 of the retaining protuberance 21 of the spring piece 2.

The sleeve 4 of a hollow construction is provided in the inner wall of the upper end thereof with an arresting edge 41, which is in turn provided with two retaining recesses 42 and 43 engageable with the upper and the lower retaining projections 212 and 213 of the retaining protuberance 21 of the spring piece 2. The sleeve 4 is fitted over the lower tubular portion 33 such that the arresting edge 41 of the sleeve 4 is stopped and retained by the flange 331 of the lower tubular portion 33 of the runner 3.

Figure 2:
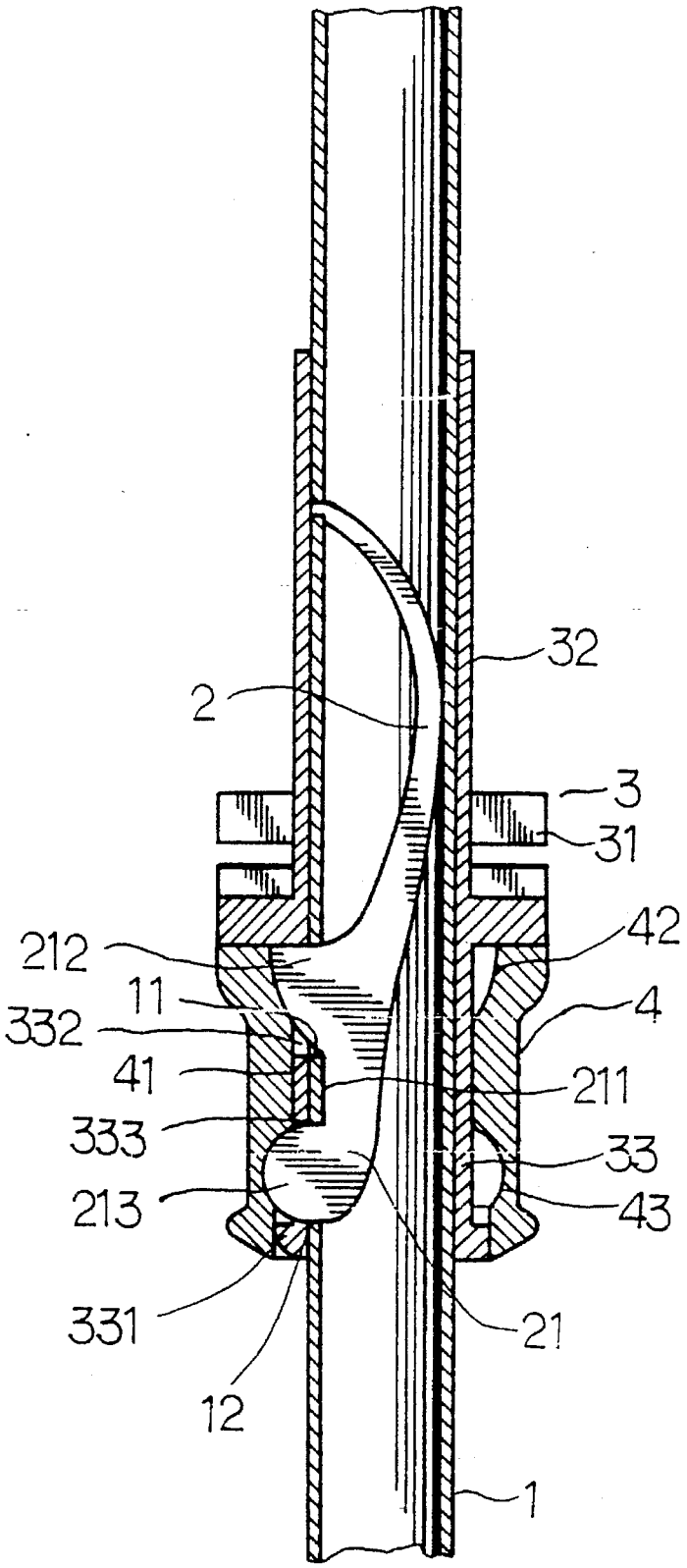
FIG. 2 shows a longitudinal sectional view of the embodiment in combination to illustrate the working of the present invention when the umbrella is being unfolded.

As illustrated in FIG. 2, when the runner 3 is pushed upwards with the finger along the shaft 1, the lower retaining projection 213 of the spring piece 21 is first forced by the top end of the tubular portion 32 of the runner 3 into the hollow interior of the shaft 1, thereby causing subsequently the upper and the lower retaining projections 212 and 213 of the spring piece 2 to be located respectively by the upper and the lower retaining holes 332 and 333 of the lower tubular portion 33 of the runner 3. As a result, the runner 3 and the shaft 1 are secured together. In the meantime, the arresting edge 41 of the sleeve 4 is located in the recessed portion 211 of the retaining protuberance 21 of the spring piece 2 and is pressed against the upper and the lower projections 212 and 213 of the retaining protuberance 21. The runner 3 is securely shielded by the sleeve 4 so as to protect the fingers from cut or bruise when the umbrella is unfolded.

Figure 3:
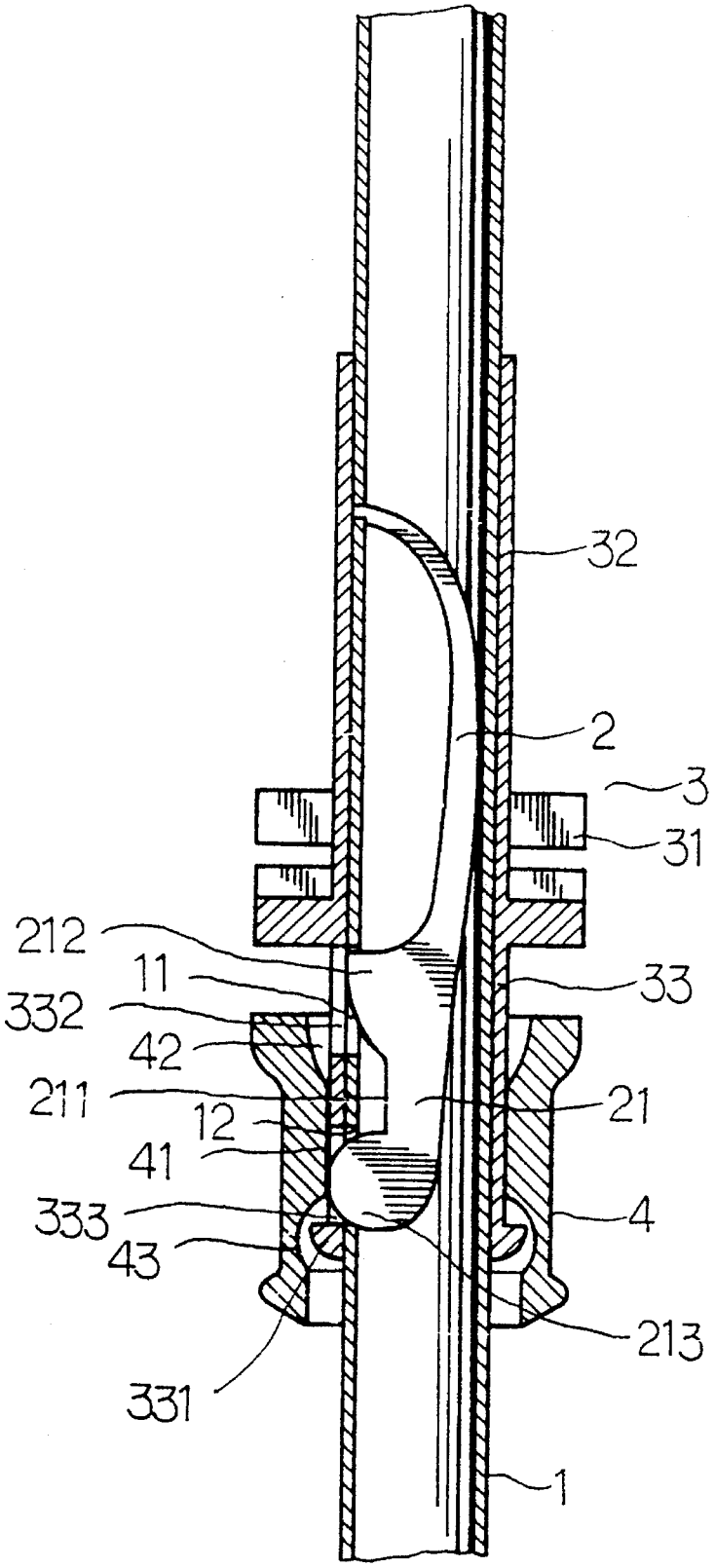
FIG. 3 shows a longitudinal sectional view of the embodiment in combination to illustrate the working of the present invention when the umbrella is being folded.

As illustrated in FIG. 3, when the unfolded umbrella is being folded by sliding the runner 3 downwards with fingers along the shaft 1, the lower retaining projection 213 of the spring piece 2 is first pressed by the arresting edge 41 of the sleeve 4 so as to force the upper and the lower retaining projections 212 and 213 of the retaining protuberance 21 into the hollow interior of the shaft 1. As a result, the runner 3 can be pulled downwards by the sleeve 4 without subjecting the fingers to cut or bruise.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claim.

What is claimed is:

1. An umbrella frame shaft assembly comprising:

a shaft of a hollow construction and provided in a wall of an upper segment thereof with two through holes separated from each other by a predetermined distance;

a spring piece comprising a retaining protuberance having an upper retaining projection, a lower retaining projection, and a recessed portion located between said upper retaining projection and said lower retaining projection, said spring piece being disposed in a hollow interior of said shaft such that said upper retaining projection and said lower retaining projection are movably jutted out of said two through holes of said shaft;

a runner comprising a main body, an upper tubular portion extending from one side of said main body, and a lower tubular portion extending from another side of said main body such that said lower tubular portion is opposite to said upper tubular portion, said lower tubular portion provided at one end thereof with a flange, said runner being fitted over said shaft such that said runner can be moved up and down along said shaft; and a sleeve provided in an inner wall thereof with an arresting edge and fitted over said lower tubular portion of said runner such that said arresting edge of said sleeve is engaged securely with said flange of said lower tubular portion of said runner;

whereto said lower retaining projection of said retaining protuberance of said spring piece is greater in height than said upper retaining projection of said retaining protuberance of said spring piece;

wherein said lower tubular portion of said runner is provided in a wall thereof with an upper retaining hole and a lower retaining hole for locating said upper retaining projection and said lower retaining projection of said retaining protuberance of said spring piece;

wherein said sleeve is provided with two retaining recesses engageable with said upper retaining projection and said lower retaining projection of said retaining protuberance of said spring piece.

2. The umbrella frame shaft assembly as defined in claim 1, wherein said upper retaining projection and said lower retaining projection of said spring piece are located by said upper retaining hole and said lower retaining hole of said runner when said runner is moved upwards to facilitate the unfolding of an umbrella.

3. The umbrella frame shaft assembly as defined in claim 2, wherein said arresting edge of said sleeve is located in said recessed portion of said spring piece so as to retain said upper retaining projection and lower retaining projection of said spring piece when said runner is moved upwards to facilitate the unfolding of said umbrella.

4. The umbrella frame shaft assembly as defined in claim 1, wherein said upper retaining projection and said lower retaining projection of said retaining protuberance of said spring piece are forced into said hollow interior of said shaft by said arresting edge of said sleeve when said runner is moved downwards to facilitate the folding of an umbrella.

5. The umbrella frame shaft assembly as defined in claim 1, wherein said upper retaining hole of said lower tubular portion of said runner is coaxial with said lower retaining hole of said lower tubular portion of said runner.

* * * * *